United States Patent [19]

Covill

[11] Patent Number: 4,785,267

[45] Date of Patent: Nov. 15, 1988

[54] RADIO FREQUENCY COMBINER

[75] Inventor: Dennis H. Covill, Tantallon, Canada

[73] Assignee: Nautical Electronic Laboratories Limited, Tantallon, Canada

[21] Appl. No.: 122,129

[22] Filed: Nov. 18, 1987

[51] Int. Cl.[4] ..... H01P 5/12

[52] U.S. Cl. ..... 333/125; 333/127; 333/136

[58] Field of Search ..... 333/125, 127, 128, 134, 333/136, 137, 161

[56] References Cited

U.S. PATENT DOCUMENTS 1,962,227 6/1934 Zepler ..... 333/136 X
3,974,465 8/1976 White ..... 333/136 X

OTHER PUBLICATIONS

*Power Divider/Combiners Small Size, Big Specs.*, R. C. Webb, Microwaves, Nov. 1981, pp. 67-74, vol. 20, No. 12.

*Primary Examiner*—Paul Gensler

[57] ABSTRACT

The present invention relates to a combining network for use in combining a plurality of coherent radio frequency sources. The combining network is comprised of a plurality of arms, one for each radio frequency source. Each arm has a first end which forms an input port and a second end which is connected to an output port which is common to all of the arms. The electrical length of each arm ranges from 55°+m(180°) to 70°+m(180°) where m=0, 1, 2, . . . of the wavelength of the radio frequency sources.

13 Claims, 2 Drawing Sheets

$\eta = 16$
ONE INPUT SHORT CIRCUITED.

$\eta = 16$
ONE INPUT OPEN CIRCUITED.

$\eta = 16$
CURRENT INTO SHORTED INPUT.

RADIO FREQUENCY COMBINER

The present invention relates to a combiner which will interconnect a plurality of individual sources of RF power to a common load such that the power of each source additively combines at the output or load and such that there is mutual isolation of the sources from one another. More particularly, the present invention relates to such a combining network that operates efficiently in the very high frequency (VHF) band.

Prior art combiners employed a configuration of transformers or transmission lines that were specifically designed to be 90° in electrical length, at the center operating frequency. However, this network of $\lambda/4$ transformers or transmission lines required the use of a star connection of load dissipating resistors. For high power transmitters the star network of resistors is required to dissipate a correspondingly high power, and as a result, are bulky, expensive and difficult to cool. The present invention provides a combining network which eliminates the need of a network of dissipative resistors.

In order that a combining network operate usefully it must provide isolation of the various power sources feeding the common load, such as an antenna, not only under perfect operating conditions but also in the event of a failure of one or more of the sources, whether that failure be the short circuiting or the open circuiting of the failed source.

The combiner must also prevent a high current flow in a short circuited failed radio frequency power source, this current being derived from the remaining operative radio frequency power sources. Such a high current flow in the failed source would of course dissipate useful signal power which would not be transmitted from the antenna. In addition such a high current flow in a failed source could cause safety problems for the transmitter as a whole.

The present invention recognizes that perfect mutual isolation is not necessary and that when a large number of sources are being combined an acceptable isolation can be achieved using a simple and inexpensive combining technique. The invention further recognizes that under the above condition there should be substantially no change in the loading of the remaining sources rather than absolutely no change.

In other words, the present invention provides a compromise with respect to mutual isolation. However, it is a good compromise since the resulting combiner is inexpensive and most importantly it is free of dissipative resistor elements which are bulky and which are difficult to cool.

The present invention recognizes and is based on the observation that there exists a range of transmission line lengths that when used in the arms of a combining network, provide acceptable mutual isolation and an acceptably low current flow in a short circuited, failed radio frequency power source without the necessity of providing a resistive network to absorb unbalanced power within the combiner.

In accordance with an aspect of the invention there is provided a combining network for use in combining a plurality of coherent radio frequency sources, said radio frequency having a wavelength, said combining network comprising a plurality of arms, each arm having a first end and a second end, said first end of each arm forming an input port for connection to one of said plurality of radio frequency sources, said second end each being connected to an output port which is common to all of said plurality of arms, each arm having a length in electrical degrees of said wavelength, that length being in the range from $55°+m(180°)$ to $70°+m(180°)$ where $m=0, 1, 2, \ldots$.

In its simplest form the above range will be between 55° and 70°, i.e., for $m=0$. If the physical arrangement of the power amplifiers is such that 55° to 70° of electrical length is too short, then the invention works equally well when the electrical length of each arm of the combiner is, for example, between 235° and 250°, when $m=1$ or between 415° and 430° when $m=2$, etc. In other words, adding multiples of 180° to the length of each arm of the combiner in no way effects the mutual isolation and removes the physical constraint on the locations of the output terminals of the RF power amplifiers. Of course for economical and band width reasons it is advantageous to minimize the value of m.

When a power amplifier stage fails either in a short circuit or an open circuit, the failure actually takes place at the junction or drain of the power transistor or transistors. In some power amplifiers the physical location of the junction or drain of these power transistors is very close to the output terminal of the power amplifier stage, and for the purposes of calculating the electrical length of each arm of the combiner network, can be considered to be located at the output terminal of the power amplifier. However, there are some RF power amplifiers that require an impedence matching network to be located between the power transistor(s) and the output terminal. If such RF power amplifiers are being used, the electrical length of the matching network must be taken into account when designing the combining network. The electrical length of each arm of the combiner network must be reduced by the electrical length of the matching network of the RF power amplifier.

If p is the electrical length of the network between the power transistor(s) and the output terminal of RF power amplifiers being combined, and q is the electical length of each arm of the combiner, then $p+q$ must fall within the range of $55°+m(180°)$ and $70°+m(180°)$ for $m=0, 1, 2, 3$, etc.

The present invention will be described in detail hereinbelow with the aid of the accompanying drawings, in which.

Figure 7:
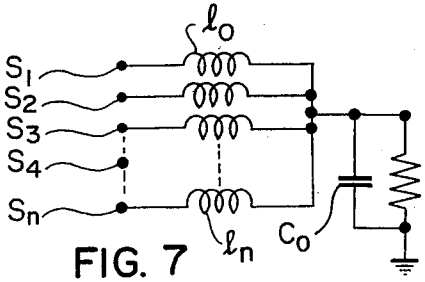
Figure 5:
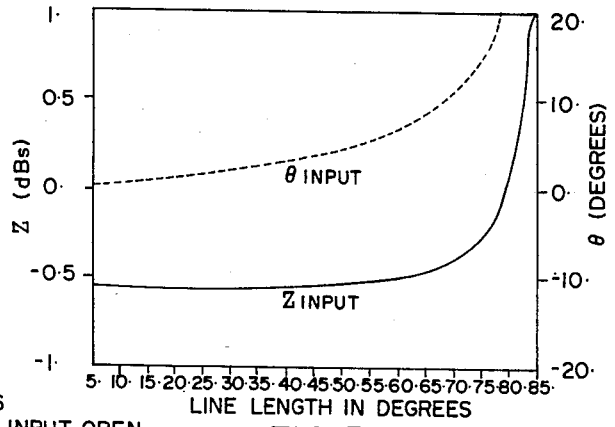
Figure 6:
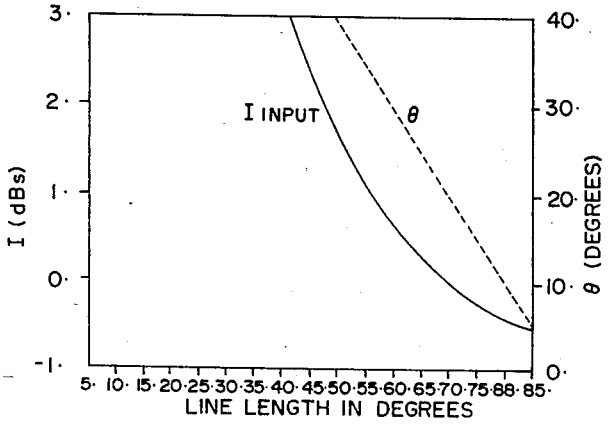

FIG. 5 is an impedance and phase diagram versus transmission line length of the load impedance at one RF source as a result of an open circuited output of another RF power source connected to the combiner of the present invention; and FIG. 6 is a current and phase diagram versus transmission line length through a short circuited output of a failed RF power source; and FIG. 7 is a schematic diagram of a filter section combiner representing another embodiment of the present invention.

Figure 1:
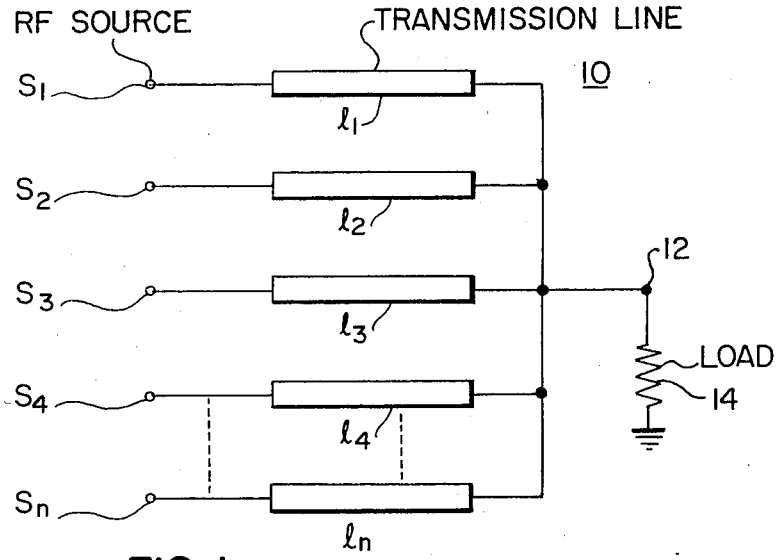
FIG. 1 is a schematic diagram of a combiner network according to the present invention.

FIG. 1 shows schematically a network 10 of the present invention. Modern solid state transmitters are comprised of a plurality of solid state RF power amplifiers which are interconnected to a single antenna via a combining network. The redundancy of such a configuration makes the resulting transmitter very reliable since the transmitter will continue to produce usable output even if one or two RF power amplifiers fail. This reliability is true only if the combiner which interconnects all the RF power amplifiers to the common load, i.e. the antenna, performs this function so that when one or two modules fail, the remaining modules continue to function and provide power to the load.

Such a characteristic will be accomplished if the modules are substantially isolated from one another such that when one module fails either with a short circuited output impedance or an open circuited output impedance, the impedance into which the remaining operative modules feed remains substantially the same. The other requirement for the safe operation of the transmitter is that if a RF power module fails, such that its output is short circuited, no substantial current flows through the shorted output.

In FIG. 1, $S_1$, $S_2$, $S_3$, $S_4$ . . . , Sn represent n input terminals for connection to the output of n RF power modules. Each RF power module is respectively connected via a transmission line length $l_1$, $l_2$, $l_3$, $l_4$, . . . $l_n$ to a common output terminal 12. The output terminal 12 is connected to a load 14 which, under normal circumstances represents an antenna. Assume that each transmission line arm has a characteristic impedance $Z_o$ and that the load 14 has an impedance of $Z_o/n$. Then, if all the RF power module sources $S_1$, $S_2$, $S_3$, $S_4$, Sn produce a coherent signal, the current from each source will additively flow through load 14 and the output voltage across the load 14 will be equal to the voltage at each source $S_1$, $S_2$ . . . Sn. The current flowing from each input port will then be $Vs/Z_o$, where Vs is equal to the source voltage when the source is correctly terminated.

If one of the n sources is considered to have failed leaving either a closed or an open circuit across the failed source, the apparent terminating impedance across the remaining n−1 sources will change.

Figure 4:
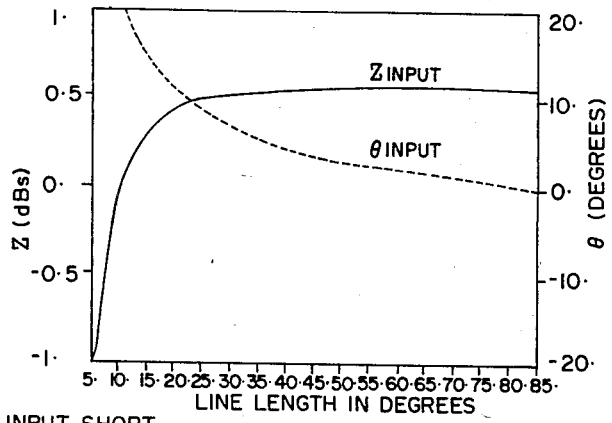
FIG. 4 is an impedance and phase diagram versus transmission line length of the load impedance at one RF power source as a result of a short circuited output of another RF power source connected to the combiner of the present invention.

For the case where n=16 the input impedance is shown in FIGS. 4 and 5 for a short circuit condition and an open circuit condition, respectively. Note that the left-hand y axis is shown in normalized impedance. The x axis represents the length of the transmission line in degrees and the right-hand y axis represents the phase change of the impedance relative to 0° which, of course, is the situation when all n sources are functioning. It should be noted that when the length of the transmission line is between 35° and 70°, the input impedance and the phase angle are not substantially different from the original values of 0 dB and $\phi=0°$. The 35° to 70° range is valid for both the short circuit case shown in FIG. 4 and the open circuit case shown in FIG. 5.

FIG. 6 shows the normalized input current for a short circuited RF power module input where 0 dB is equal to the original current level prior to failure. This criteria is slightly more critical and in respect of transmission line length the current becomes somewhat high for values less than 55°. If this short circuit current limitation is taken into account an acceptable range for transmission line lengths for each of the n arms of the combiner network is from 55° to 70°.

Actual impedance and phase angle changes were calculated for a combiner network having n=16 and transmission line sections equal to 60° of the carrier frequency. The results are as follows:

Z input for 1 input short circuited = 1.0659 $Z_o$ at 2.2° inductive.

Z input for 1 input open circuited = 0.944 $Z_o$ at 6.6° inductive.

I input at shorted input = 1.082 $I_o$ at 30° capacitive.

These results are well within the acceptable range for combining isolation and current flow in a short circuited failed RF power module.

FIGS. 4, 5 and 6 were generated via computer analysis.

Figure 2:
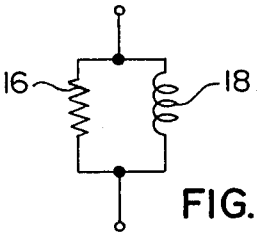
FIGS. 2 and 3 are equivalent circuit diagrams used in an explanation of the theory of operation of the present invention.
Figure 3:
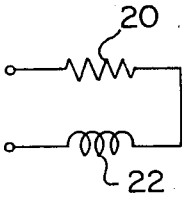

FIGS. 2 and 3 are equivalent circuit models used for a more detailed analysis. FIG. 2 is the circuit model for the short circuit case and resistor 16 and inductor 18 take on values of $nZ_o/(n-1)$ and $+jnZ_o\tan\phi$, respectively, so that the input impedance for any port that remains operational with one port short circuited is $$Z_{in} = \frac{n}{n-1} Z_o \text{ in parallel with } +jnZ_o\tan\phi \qquad 1$$

where n equals the number of input ports of the combiner and $\phi$ equals the transmission line length in degrees.

It can also be shown using the model circuit of FIG. 2 that the current I input to a failed short circuited port is $$I_n = \frac{n}{n-1} I_o \times \frac{\sqrt{1+\tan^2\phi}}{\tan\phi} \qquad 2$$

at a leading angle of $(90-\phi)$ degrees.

FIG. 3 is the circuit model for the open circuited case and resistor 20 and inductor 22 take on values of $$\frac{n-1}{n}(Z_o) \text{ and } +j\frac{1}{n} Z_o\tan\phi,$$

respectively, so that the input impedance for any port that remains operational with one port open circuited is $$Z_{in} = \frac{n-1}{n} Z_o + j\frac{1}{n} Z_o\tan\phi \qquad 3$$

It is convenient to make the transmission lines actual transmission lines at VHF frequencies. However, at lower frequencies the transmission lines can be replaced, as is well known in the art, by low-pass filter type sections. Each section may have any number of poles equal to or greater than 2 poles. The 2 pole case is merely a series inductor in each arm of the combiner and a lumped capacitance can be located across the load. With a combiner using filter sections rather than transmission line lengths, the value is taken to be the filter delay under matched conditions.

FIG. 7 shows a simple double pole filter system used as a combiner. In FIG. 7 each arm is comprised of an inductor $l_o$ and a mutual capacitance $C_o$ is located in parallel with the load.

For the case where each RF power amplifier has a matching network interconnecting its power transistor(s) with its output terminal, the electrical length of the matching network must be taken into account. In such a case the points $S_1$, $S_2$, $S_3$, $S_4$, $S_n$ shown in FIG. 1 should be considered to be located at the junction of the power transistor(s). In that case $l_n$ equals the sum of the electrical length of the matching network and the transmission line length of each combiner arm.

Acceptable isolation has been achieved for the above embodiments for n equal to or greater than 4.

I claim:

1. A combining network for use in combining a plurality of coherent radio frequency sources, said radio frequency having a wavelength, said combining network comprising a plurality of arms, each arm having a first end and a second end, said first end of each arm forming an input port for connection to one of said plurality of radio frequency sources, said second end each being connected to an output port which is common to all of said plurality of arms, each arm having a length in electrical degrees of said wavelength, that length being in the range from 55°+m(180°) to 70°+m(180°) where m=0, 1, 2, 3, . . . .

2. The combining network of claim 1 wherein the electrical length of each arm is 60°+m(180°) of the wavelength.

3. The combining network of claim 1 or 2 wherein the number of arms is 16.

4. The combining network of claim 1 or 2 wherein each arm includes at least an inductor element of a double pole filter and the electrical length of each arm is equivalent to the filter delay.

5. The combining network of claim 1 or 2 wherein the output port is connected to a load, said load having an impedance $Z_o/n$ where $Z_o$ is the characteristic impedance of each arm and n equals the number of arms.

6. A combining network for use in combining n number of coherent radio frequency sources, said radio frequency having a wavelength, said combining network comprising n number of arms, each arm having a first end and a second end, said first end of each arm forming an input port for connection to one of said n radio frequency sources, said second end each being connected to an output port which is common to all of said n number of arms, each arm having a length in electrical degrees of said wavelength, that length being in the range from 55°+m(180°) to 70°+m(180°), wherein n is a positive integer greater than 3 and m=0, 1, 2, 3, . . . .

7. The combining network of claim 6 wherein the electrical length of each arm is 60°+m(180°) of the wavelength.

8. The combining network of claim 6 or 7 wherein n=16.

9. The combining network of claim 6 wherein each arm includes at least an inductor element of a double pole filter and the electrical length of each arm is equivalent to the filter delay.

10. A combining network for use in combining a plurality of coherent radio frequency signals produced by a plurality of radio frequency power amplifier, each amplifier having at least one power transistor, an output terminal and a network joining said at least one power output transistor to said output terminal, said network having an electrical length of p° of said coherent radio frequency, said combining network comprising a plurality of arms, each arm having a first end and a second end, said first end of each arm being connected to a respective output terminal of each of said plurality of said radio frequency power amplifiers, said second end each being connected to an output port which is common to all of said plurality of arms, each arm having an electrical length of q° of said coherent radio frequency, wherein the combined electrical length of each network and each arm is p°+q° and wherein said combined electrical length ranges between 55°+m(180°) and 70°+m(180°) where m=0, 1, 2, . . . .

11. The combining network of claim 10, wherein p°+q°=60°+m(180°).

12. The combining network of claim 10 or 11 wherein the number of arms is 16.

13. The combining network of claim 10 or 11, wherein each arm includes an inductor element of a double pole filter and the electrical length of each arm is q° and is equivalent to the filter delay.

* * * * *